United States Patent [19]

Denis

[11] Patent Number: 4,548,414

[45] Date of Patent: Oct. 22, 1985

[54] APPARATUS FOR PRESENTING A TARGET AT A WINDOW

[76] Inventor: Bernard Denis, "Le Blavet", 49300 Cholet, France

[21] Appl. No.: 705,067

[22] Filed: Feb. 25, 1985

[30] Foreign Application Priority Data

Feb. 27, 1984 [FR] France ..... 84 02949

[51] Int. Cl.[4] ..... F41J 9/02

[52] U.S. Cl. ..... 273/367; 273/359; 273/368; 273/370; 273/404; 273/407

[58] Field of Search ..... 273/366–370, 273/359, 404, 407, 410

[56] References Cited

U.S. PATENT DOCUMENTS

| | | | |
|---|---|---|---|
| 1,463,931 | 8/1923 | Tucker | 273/370 |
| 2,612,743 | 10/1952 | Strother | 273/366 X |
| 3,502,334 | 3/1970 | Tippit | 273/366 X |
| 3,531,120 | 9/1970 | Ross et al. | 273/370 |
| 3,737,165 | 6/1973 | Pencyla | 273/410 |
| 3,744,796 | 7/1973 | Penault | 273/369 |
| 4,076,247 | 2/1978 | Kim et al. | 273/366 |
| 4,355,981 | 10/1982 | Kuperman et al. | 273/369 X |

FOREIGN PATENT DOCUMENTS

| | | | |
|---|---|---|---|
| 496873 | 4/1930 | Fed. Rep. of Germany | 273/410 |
| 37763 | 2/1907 | Switzerland | 273/369 |
| 579407 | 9/1976 | Switzerland | 273/370 |
| 29144 | of 1910 | United Kingdom | 273/370 |

*Primary Examiner*—Paul E. Shapiro

*Attorney, Agent, or Firm*—McCormick, Paulding & Huber

[57] ABSTRACT

At least one target (10, 11) is caused to move with complex motion combining rotation about an axis (5) which is approximately horizontal and translation along a direction which is approximately perpendicular to said axis (5) behind an opaque panel (3) delimiting a window (4). By giving suitable directions, amplitudes and speeds to these respective motions, the apparent motion of the target as seen through the window (4) is pseudo-random in time and concerning its trajectory between two passes behind the panel. This increases the difficulty, and hence the attraction of target shooting.

18 Claims, 3 Drawing Figures

APPARATUS FOR PRESENTING A TARGET AT A WINDOW

The present invention relates to moving targets, and in particular to apparatus for presenting a target at a window to be shot at.

BACKGROUND OF THE INVENTION

In order to make target shooting more attractive, proposals have already been made to replace fixed targets by moving targets which move past a window through which a user seeks to hit the target. In order to improve user reflexes, means are often provided not only for causing the targets to move past the window, but also for causing them to pop or flip up suddenly as they pass the window in a manner which is as unexpected as possible.

However, it appears that the unexpected nature of such targets popping or flipping up is lost on the practised user who rapidly learns the privileged positions at which targets are likely to appear or disappear rapidly as they pass the window.

Preferred embodiments of the present invention remedy this drawback by providing apparatus which presents one or more targets at a window in a pseudo-random manner, i.e. in a manner which is unlikely to be learned by the user.

SUMMARY OF THE INVENTION

To this end, the present invention provides apparatus for presenting a target at a window, the target being presented downstream from the window in a predetermined and generally horizontal shooting direction, the dimensions of the target in directions perpendicular to said predetermined direction being smaller than the corresponding dimensions of the window, the apparatus including means for applying complex motion to the target, which motion combines rotation about an axis which is approximately horizontal and translation along a direction which is approximately perpendicular to the direction of said axis, said motion taking place downstream from an opaque fixed panel which delimits said window, the apparatus further including means for applying to said rotation and to said translation respective directions and/or amplitudes and/or speeds such that the target is presented at the window in a manner which is pseudo-random in time and in trajectory between successive passes behind the panel, i.e. not at the window.

This combination of a rotary movement and a translation movement, in particular if an operator varies the directions, amplitudes and speeds thereof independently of one another and at will, or if a suitably programmed computer is used to control these factors, for example to make these variations genuinely random, makes it possible to present the target at the window by causing it to follow trajectories which are completely unexpected by the user who, in particular when the target is behind the panel, i.e. not at the window, does not know where the target will reappear at the window, nor the trajectory it will then be following, nor its speed, nor the manner in which these factors may change. In particular, the user is thus placed in conditions which are similar to the highly attractive conditions of clay pigeon shooting, but without the need for the large space and expense associated with clay pigeon shooting.

In an even more attractive embodiment of the present invention, means are provided to move a plurality of such targets to provide a complex motion which combines rotation about respective approximately horizontal axes and respective translation motions along respective directions that are approximately perpendicular to the directions of said axes, behind the panel relative to the shooting direction. Means are provided to give each of these movements its own direction, amplitude and speed which factors are advantageously variable such that two or more of the targets may cross one another at the window in a manner which is pseudo-random in time and in trajectory between successive passes behind the panel, i.e. not at the window.

The objective of the shooting can then be to hit both targets simultaneously as they cross each other, thus requiring the user to anticipate the movements of each of the targets and thus constituting an excellent exercise for the reflexes.

Also in this case, it is advantageous for an operator or a suitably programmed computer to vary the directions, amplitudes, speeds of rotation and speeds of translation independently from one another.

The terms "shoot" and "shooting" are used in this specification not only in the usual senses as applied to firearms or bows and arrows, but more generally to cover any form dispatching any kind of projectile, for example throwing a dart or a javelin, bowling a ball, shining a light beam, etc.

BRIEF DESCRIPTION OF THE DRAWINGS

Two embodiments of the invention applicable to shooting at a target with a firearm, are described by way of example with reference to the accompanying drawings, in which.

MORE DETAILED DESCRIPTION

Figure 2:
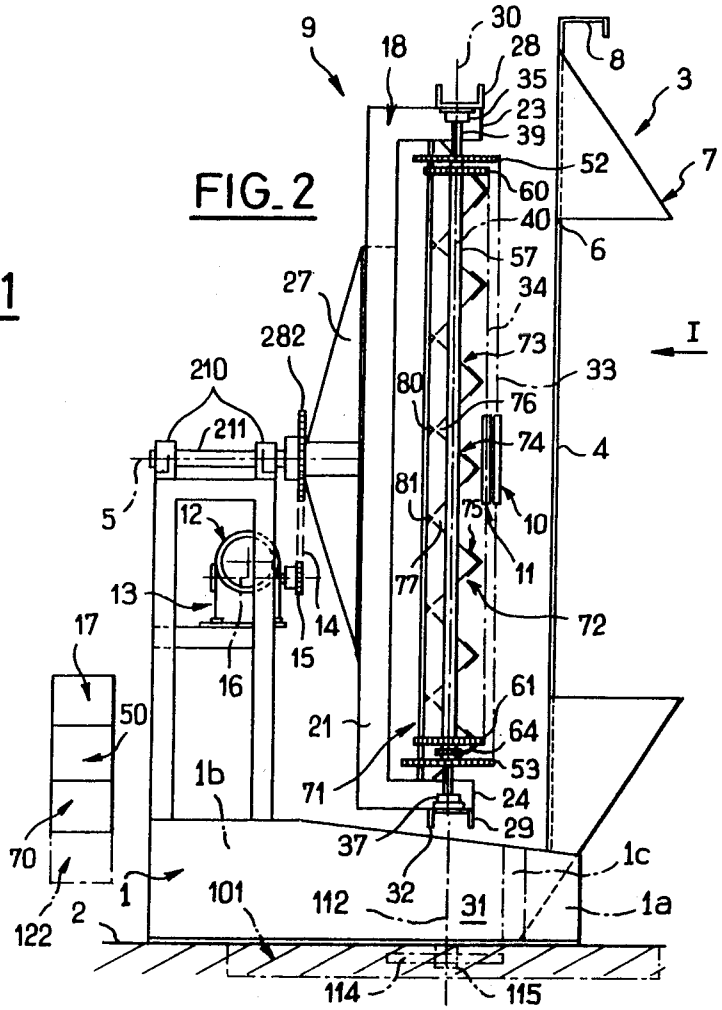
FIG. 2 is a side view of the FIG. 1 apparatus seen in the direction of arrow II in FIG. 1.
Figure 1:
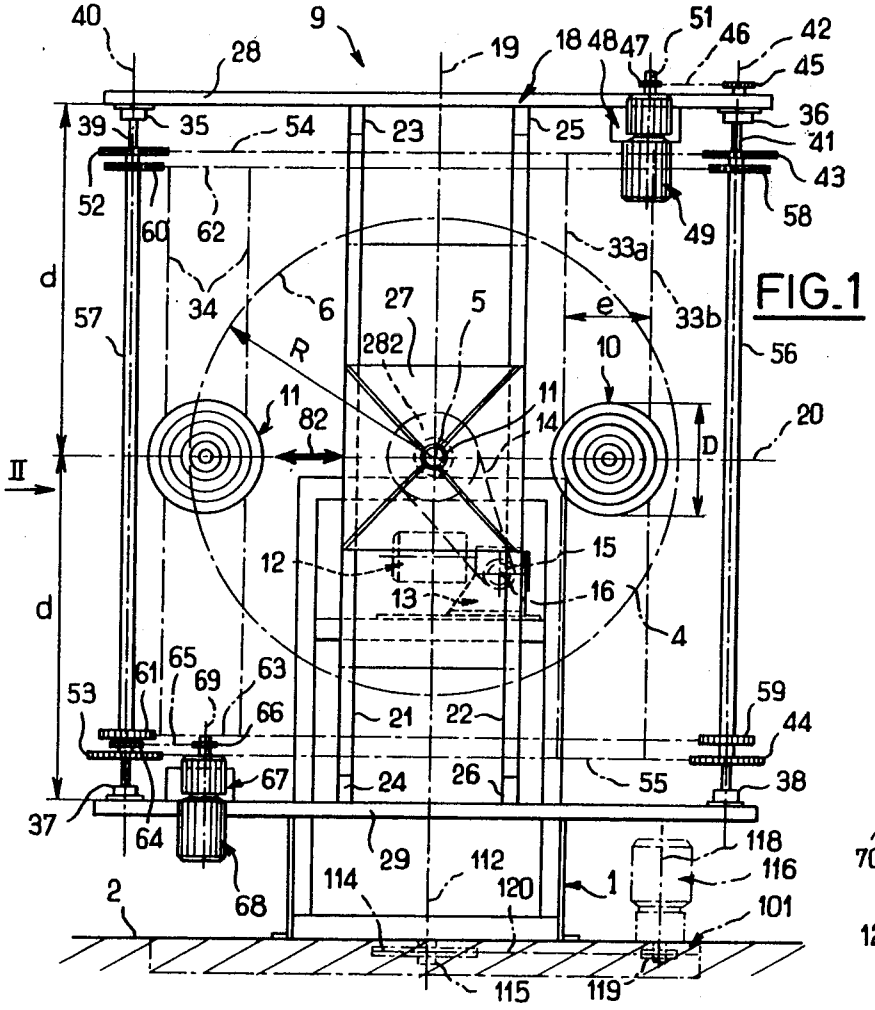
FIG. 1 is a front view of first apparatus in accordance with the invention, i.e. seen from the shooting direction as is indicated by an arrow in FIG. 2, with the opaque panel delimiting the target window being omitted.

Reference is made initially to FIGS. 1 and 2, in which 1 designates a rigid support frame which is fixed relative to the ground 2 either by virtue of its own weight or else by any other appropriate means, not shown. In the following description, terms relating to the orientation and to the position of the various components described are given with reference to the position in which the apparatus is used and as defined by the rigid support frame 1 being fixed to the ground 2 as illustrated.

The support frame 1 is rigidly fixed to a rigid, opaque front panel 3 which, in the present example, is approximately vertical and perpendicular to a predetermined shooting direction I which is itself approximately horizontal. The panel 3 is pierced by a window 4 whose outer periphery 6 is defined by the panel. In the illustrated preferred embodiment, this periphery is in the form of a circular cylinder about an axis 5 which is substantially parallel to the shooting direction I, i.e. which is approximately horizontal. The window is thus fixed relative to the support frame 1. All around the outer periphery 6 of the window 4, the opaque front panel 3 is fitted with anti-ricochet deflectors such as 7 suitable for receiving the impact of projectiles moving approximately in the direction I but outside the window 4, for deflecting such projectiles towards stop means such as 8 by absorbing as much of their energy as possible. This design is known per se, and is not described in greater detail here.

In accordance with the present invention, means 9 are provided for presenting at least one target, and more precisely for presenting two targets 10 and 11 in this example, at the window 4 and downstream therefrom in the shooting direction I. These presentation means 9 are mounted on the support frame 1 and are suitable for giving the shooter the illusion of the two targets 10 and 11 being randomly presented at the window. The presentation is random both in time and in trajectory followed by the target, i.e. there is an apparently random relationship between two successive passes of either target at the window between occasions when the targets are behind the panel 3 which hides them from view. It may be observed that the apparatus could equally be used to present a single target or to present more than two targets.

To this end, in the example shown, the support frame 1 is rigidly fixed to bearings 210 located downstream from the window 4 in the shooting direction I and suitable for receiving and guiding a shaft 211 in rotation about the axis 5 and relative to the support frame 1.

The shaft 211 is fixed to a toothed wheel 282 which is connected by a chain 14 to a chain drive wheel 15 fixed to an output shaft having an axis 15 which is parallel to the axis 5 and which is likewise fixed relative to the support frame 1. The output shaft belongs to a variable speed transmission 13 which is itself mounted on the output shaft of an electric motor 12 such that while the motor 12 is operating, it is possible to act on the adjustment of the variable speed transmission 13 so as to cause the shaft 211 to rotate about the axis 5 relative to the support frame 1 in one direction or the other and optionally to alternate between opposite directions, at a speed and/or, where applicable, with an amplitude which is advantageously variable at will during rotation either by manual remote control of the variable speed transmission 13 or by controlling the transmission 13 with a predetermined program, for example by means of a computer. The design of means 17 suitable for use to this end forms part of the normal skills of the person skilled in the art and these means are not described further.

In addition to the toothed wheel 82, the shaft 211 is fixed between the bearings 20 and the front panel 3 to a rigid frame 18 having two planes of symmetry 19 and 20 proper thereto which planes intersect at right angles on the axis 5, thus ensuring balanced rotation thereabout relative to the support frame 1.

More precisely, in the embodiment illustrated, the frame 18 comprises two rigid arms 21 and 22 disposed parallel to each other and symmetrically about the plane 19 in the same mean plane perpendicular to the axis 5, close to which axis they are rigidly fixed to the shaft 211, e.g. by means of a rigid hub 27. At each end of each of the arms 21 and 22 there is a forwardly directed cantilever beam located at a distance from the axis 5 which is greater than the radius R of the window 4. Cantilever beams 23 and 24 are at respective ends of the arm 21 and cantilever beams 25 and 26 are at respective ends of the arm 22. These cantilever beams 23 to 26 project forwardly from the arms 21 and 22 towards the panel 3 and parallel to the axis 5 in order to be rigidly fixed to two rigid rectilinear beams 28 and 29 which are parallel to each other, are symmetrically disposed about the plane 20 and which are situated in the same mean plane 30 which is perpendicular to the axis 5 and which is located between the arms 21 and 22 and the front panel 3. Each of the beams 28 and 29 is additionally symmetrically disposed about the plane 19 and is perpendicular thereto. It may be observed that the distance d separating the plane 20 from each of the beams 28 and 29 is greater than the radius R of the window 4, such that regardless of the rotation of the frame 18 about the axis 5 relative to the support frame 1, the zone including the beams 28 and 29 never appears at the window 4 as seen from the direction I. It may also be observed that the design of the support frame 1 in its zone 31 which is radially placed relative to the axis 5 and facing the frame 18 ensures that sufficient play 32 is left there between to enable the chassis 18 to rotate about the axis 5 relative to the support frame 1 at least through a go-and-return angle of less than 180° as is the case for the example illustrated, or else through a go-and-return angle of at least 180° or even through continuous rotation in a constant direction, as is the case for non-illustrated variants.

The frame 18 described above serves to link the support frame 1 via the shaft 211 to target-carrying means such as 33 for the target 10 and 34 for the target 11. These target-carrying means are mounted on the frame 18 in such a manner as to be capable of moving in translation relative thereto.

To this end, each of the beams 28 and 29 has two end bearings respectively 35 and 36, and 37 and 38 which are disposed in pairs that are symmetrical about the plane 19 for the two bearings on the same beam and which are symmetrical about the plane 20 for corresponding ones of the bearings on different ones of the beams.

Thus, the bearing 35 on the beam 28 and the bearing 37 on the beam 29 are symmetrically disposed about the plane 20 and receive a rectilinear shaft 39 about an axis 40. They serve to hold the axis 40 in a direction which is perpendicular to the plane 20 relative to the frame 18 and to guide the shaft 39 in rotation about said axis 40 and relative to frame 18. Likewise the bearings 36 and 38 correspond to each other and are symmetrically disposed about the plane 20 to receive a rectilinear shaft 41 about an axis 42. These bearings hold the axis 42 relative to the frame 18 in a position which is symmetrical to that of the axis 40 by reflection in the plane 19, and they serve to guide the shaft 41 in rotation about the axis 42 and relative to the frame 18.

The shaft 41 extends beyond the bearing 46 and the beam 28 into a zone where it is fixed to a chain wheel 45 driven by a drive chain 46 connected to a chain wheel 47 which is fixed to the output shaft from a variable speed transmission 48 which is itself fixed to the frame 28 and which has an input connected to the output shaft from an electric motor 49 which is also fixed to the beam 28. The motor and transmission assembly 49–48 is remote controlled concerning the supply of electricity to the motor 49 and concerning the adjustments of the transmission 48 so as to be able to adjust the speed of rotation of the wheel 47 about its axis 51 which is fixed relative to the beam 28 and which is parallel to the axis 42, and also to determine the direction of this rotation which may be continuous in one direction or which may alternate. Further, the amplitude of this rotation may be varied in the case where it alternates from one direction to the other by the means 50 which are entirely comparable to the means 17 but which act in such a manner that the adjustment of the assembly 48–49 is independent of the adjustment of the assembly 12–13.

Further, the shaft 41 has two identical chain wheels 43 and 44 symmetrically disposed about the plane 19, between the bearings 36 and 38 and respectively adjacent thereto. In like manner, the shaft 39 has chain wheels 52 and 53 which are respectively identical to the wheels 43 and 44.

A continuous chain 54 extends over the two chain wheels 43 and 52 which are on the same side of the plane 19, and it may be kept taut by conventional means not shown. Likewise, a similar chain 55 extends over the chain wheels 44 and 53 symmetrically about the plane 20, and the two chains 54 and 55 are interconnected in symmetrically corresponding zones about the plane 20 by the target-carrying means 33. These means may be of various kinds, and for example the figure shows the target-carrying means 33 in the form of two flexible straps such as cables 33*a* and 33*b* each of which is tensioned between the two chains so as to be rectilinear and oriented perpendicularly to the plane 20. The two straps 33*a* and 33*b* are at a spacing e which is less than diameter D of the target 10 which is conventionally circular in shape. It is thus possible to fix the target to the straps by any appropriate means, for example by resilient stapling so that the target occupies a mean position which is perpendicular to the plane 20. The target may, for example, be symmetrically disposed about the plane 20, as illustrated. It may be observed that the diameter D of the target 10 is much less than the diameter 2 of the window 4, and that the spacing the shafts 40 and 42 is itself greater than 2R, whereby rotating the wheel 47 by means of the assembly 48–49 in a given direction moves the target 10 as driven by the chain 54 and 55 to which it is attached by the straps 33*a* and 33*b* along the panel 3 and downstream from the panel relative to the shooting direction I. The resulting translation movement has an average direction 82 which is fixed relative to the frame 18, which is included in the plane 20 and which is perpendicular to the plane 19, i.e. perpendicular to the axis 5. This movement serves to alternate the position of the target from being behind the panel 3 where it is hidden from sight or at the window 4 between two occasions when it is behind the panel. During this movement, the respective zones of the chains 54 and 55 which carry the straps 33*a* and 33*b* are situated on the same side of the mean plane 30 as is the panel 3, and the mean plane of the target is approximately perpendicular to the shooting direction. If the direction of rotation of the wheel 47 is constant, the passage along the panel 3 always takes place in the same fixed direction relative to the chassis 18, and alternates with translation displacement on the other side of the plane 30 by virtue of the target going round the shafts 40 and 42. Alternatively, the direction of rotation of the wheel 47 may be reversed in an alternating manner with possible stop periods of the motor 49 at the changes of direction, in which case there is no need for the target to go round the shafts 40 and 42 to follow a path on the other side of the mean plane 30. If the wheel 47 is reversed, thus causing the target 10 to move along the panel 3 in the oppose direction, this reversal of direction may take place when the target 10 is at the window 4 or, alternatively, it may take place only when the target 10 is hidden by the panel 3.

In the embodiment illustrated, the other target 11 is carried and moved by means of a hollow shaft 56 which is coaxially mounted on the shaft 41 between the chain wheels 43 and 44, said hollow shaft being rotatable about the axis 42 relative to the frame 18 independently of the shaft 41 on which it is mounted free to rotate. Similarly, a second hollow shaft 57 is disposed coaxially about the shaft 39 between the chain wheels 52 and 53 and is rotatable thereabout about the axis 40 so that it too may rotate about this axis relative to the frame 18 independently of the rotation of the shaft 39.

The hollow shaft 56 has two identical chain wheels 58 and 59 of smaller diameter than the chain wheels 43 and 44 which are fixed to its ends in the vicinity of the chain wheels 43 and 44. Likewise the hollow shaft 57 has two identical chain wheels 60 and 61 of identical diameter to the chain wheels 58 and 59, i.e. less than the diameter of the wheels 52 and 53, which are fixed to the ends thereof in the vicinity of the chain wheels 52 and 53.

Two endless loop chains 62 and 63 are disposed around the wheels 58 and 60 or 59 and 61 as the case may be and they are kept taut, if necessary, by conventional means (not shown). These chains are symmetrically disposed about the plane 20 and they have symmetrically corresponding zones about the plane 20 via which they are fixed to target-carrying means 34 which are entirely similar to the means 33 and which carry the target 11 in the same way as the means 33 carry the target 10. In other words, the target 11, which is identical to the target 10, is symmetrically disposed about the plane 20 and has a mean plane which is approximately perpendicular to the shooting direction I with the zones of the chains 62 and 63 which carry the target 11 being situated on the same side of the mean plane 30 as is the panel 3, such that the target 11 is then between the mean plane 30 and the plane of the panel 3.

An extra chain wheel 46 is mounted on the hollow shaft 57 between its chain wheel 61 and the adjacent chain wheel 53 of the shaft 39. The extra chain wheel 64 is connected by a chain 65 to a drive chain wheel 66 having an axis 69 parallel to the axis 64 and mounted on a variable speed transmission 67 which is coupled to an electric motor 68. The variable transmission 67 and the motor 68 are fixed to the beam 29 in a position which is approximately symmetrical to that of the assembly 48–49 about the axis 5 for reasons of equilibrium.

The assembly 67–68 is remote controlled as are the assemblies 48–49 and 12–13 by means 70 which are substantially identical to the means 50 and 17 and which operate independently from said other means to stop and start the drive wheel 66 and to adjust the speed thereof. The variable transmission is preferably capable of continuous variation in said speed. The direction may either be constant or else it may be freely reversible, in which case the amplitude of displacement between two reversals should also be freely adjustable.

It will readily be understood that the means 17, 50 and 70 which operate independently from one another and which act respectively to rotate the frame 18 relative to the support frame 1 about the axis 5, to translate the target 10 perpendicularly to the axis 5 along the panel 3 and past the window 4, and to translate the target 11 in like manner on a trajectory parallel to the trajectory of the target 10, may each be used to vary the speed, direction and amplitude of the corresponding motion in any combination with the other motions. As a result, seen from the shooting position, the appearance of the target 10 or the target 11 or of both targets simultaneously at the window 10 can be made to appear random, both with respect to time and with respect to the trajectory followed by the target past the window.

When, as in the example shown, at least two targets are provided with independent motion, the objective may be to hit both targets simultaneously when they are superposed, e.g. when they cross between the mean plane 30 and the panel 3 in a position visible through the window 4. In such a case, the objective can be made more difficult to achieve by reversing the direction of translation of one or both of the targets when they can be seen through the window 4, or by sudden variations in their speeds.

It may also be observed that, without going beyond the scope of the present invention, other means could be provided to combine rotation about an axis approximately parallel to the shooting direction (i.e. the axis 5 in this case) with translation along a direction approximately perpendicular to said axis downstream in the shooting direction I from an opaque panel 3 which delimits the window 4 in order to obtain complex target motion. When a plurality of targets are provided, they may rotate about different axes for the rotation components of their complex motions, and/or they may move in different directions for the translation components of their complex motions. Regardless of the solution chosen, it is possible, without going beyond the scope of the present invention, to replace the combination of movements described, i.e. the displacement of target-carrying means such as 33 and 34 in translation relative to a frame 18 which connects them to a support frame 1, together with the rotation movement of the frame 18 relative to the support frame 1, by a translation movement relative to the support frame 1 and substantially along a direction perpendicular to the shooting direction of a frame comparable to the frame 18 except in that it carries target-carrying means suitable for performing relative rotation about an axis which is generally parallel to the shooting direction. It is also possible to provide more complex movement combinations, and for example a variant embodiment of the invention could have the targets 10 and 11 movably mounted relative to the chains by which they are carried so as to be movable in translation relative thereto, e.g. up and down parallel to the plane 19, or else to be rotatable about an axis situated approximately parallel to the shooting direction I as the target moves past the panel 3 and the window 4. In either case the additional motion should be under the control of means which may be adjusted at will independently of the means 17, 50 and 70 provided for adjusting the other motions.

A more complicated version of the apparatus may be provided for combining the above-described movement of the, or each, target, i.e. rotation about an approximately horizontal axis and translation along a direction which is approximately perpendicular to the direction of the axis, with a rotary movement about an axis which is approximately vertical and whose direction and/or amplitude and/or speed may be varied automatically or manually so as to contribute to the presentation of the, or each, target at the window in a manner which is pseudo-random in time and in trajectory between successive passes between any two occasions when any of the targets is hidden behind the panel.

The additional components for converting the previously described embodiment into one which additionally includes rotation about a substantially vertical axis, are shown in chain-dotted lines in FIGS. 1 and 2 and are now described.

Instead of being rigidly fixed to the ground 2, the support frame 1 is replaced by two separate support frame portions 1*a* and 1*b*, with the first portion 1*a* being situated upstream from the second portion 1*b* relative to the shooting direction I. The first or upstream portion 1*a* is fixed to the ground 2 and is rigidly fixed to the rigid front panel 3 which is disposed as before. The second or downstream portion 1*b* is movable relative to the ground 2 and relative to the first portion 1*a* by rotating about an approximately vertical axis 112, and serves to support the bearings 210 of the shaft 211 together with the electric drive motor 12 for said shaft 211, and thus via said shaft 211 serves to support the frame assembly 18 and the means supported thereby as described for the fixed support frame 1. Advantageously, the vertical rotation axis 112 lies in the mean plane 30 and intersects the generally horizontal axis 5. The two portions 1*a* and 1*b* of the support frame are separated by play 1*c* leaving room for their relative rotation.

To this end, the support frame portion 1*a* may be fixed to an approximately horizontal ground or sole plate 101 which serves firstly to provide a lower bearing surface for the support frame portion 1*b*, and secondly as a rotation guide bearing about the axis 102 for a downwardly projecting stub axle 115 which is fixed to the rotatable portion 1*b*. The stub axle 115 is fixed to a toothed wheel 114 which is connected via a chain 120 to a chain drive wheel 119 which is in turn fixed to the drive shaft 117 having an axis 118 parallel to the axis 112 of a motor and variable transmission assembly 116 mounted fixedly to the sole plate 101. Means 122 which are completely analogous to the means 17, 50 and 70 and which are independent therefrom, serve to cause the portion 1*b* to move, i.e. to move the axis 5 and thus the means 9 with a pivoting motion which alternates backwards and forwards about the axis 112 with a speed and/or an amplitude which are advantageously variable at will during rotation either by manual remote control of the assembly 116 or by program control thereof, e.g. by means of a computer.

Thus, by acting independently via the remote control means 122, 17, 50 and 70, on the directions, speeds and optionally on the amplitudes of the following motions respectively: rotation of the support frame portion 1*b* about the axis 112 relative to the sole plate 101; rotation of the frame 18 about the axis 5 relative to the support frame portion 1*b*; and translation of the targets 10 and 11 in the direction 82 relative to the frame 18; the targets 10 and 11 may be moved past the window 4 in a manner which is random or which appears to be random to the shooter. This combination has the added attraction, relative to the implementation initially described with reference to FIGS. 1 and 2, of making it possible to cause a target to move towards or away from the user by arranging for the portion 1*b* to point the axis 5 in a direction 5 which is not parallel to the shooting direction I.

In a simplified version of this variant, means could be provided to rotate the portions 1*a* and 1*b* about the axis 112 relative to the sole plate 101.

In addition, various arrangements are advantageously provided to protect the apparatus.

In the embodiment shown, a plane armor plating plate 71 is fixed for this purpose to the frame 18 perpendicularly to the axis 5 and extends at least over the portion visible at the window 4 from the shooting direction I.

In order to hide the target 10 and 11 from the shooter when they move behind the mean plane 30 relative to the panel 3, the armor 71 is disposed inside the chains 62 and 63 so that the paths of these chains and also of the chains 54 and 55, the target-carrying means 33 and 34, and the targets 10 and 11 move round behind the plate 71.

On the window side of the plate 71, i.e. the side facing the shooting direction I, there are anti-ricochet means which are likewise contained inside the paths of the moving targets.

Figure 3:
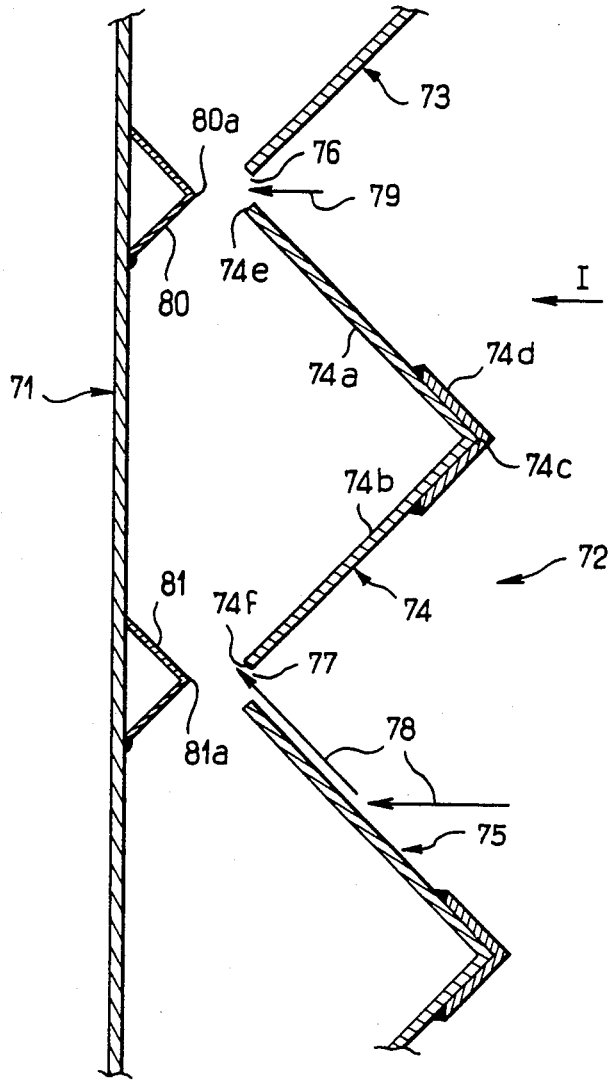
FIG. 3 is a similar view to FIG. 2 but on a larger scale and showing a detail of anti-ricochet armor plate equipping the apparatus.

As can be seen more clearly in FIG. 3, the anti-ricochet means 72 comprise a plurality of juxtaposed deflectors such as 73, 74 and 75 which are convex towards the window 4 and which define in adjacent pairs slots such as 76 and 77 such that a projectile striking one of the deflectors, e.g. the deflector 75 in a direction approximately corresponding to the direction I is deflected by the deflector 75 towards the immediately adjacent slot 77 and at an angle relative to the armor plate 71 so that the projectile hits the armor plate obliquely rather than at a right angle, and so that it hits the plate after losing a portion of its energy. The path of such projectile is shown diagrammatically by arrows 78 in FIG. 3.

Advantageously, each deflector 73, 74, 75 is in the form of a strip of angle bar having two walls such as 74*a* and 74*b* respectively in the case of the deflector 74. These walls have plane main faces which are disposed at about 45° relative to the plate 71 and which converge towards each other when going away from the plate 71 so as to meet at 90° along a common ridge such as 74*b* which is advantageously reinforced by a further strip of angle bar such as 74*b* on the window-facing side of said ridge.

It may be observed that in this manner each of the deflectors such as 73, 74, 75 is concave towards the armor plate 71 which enables the deflectors to co-operate with the armor plate to act as a trap for projectiles which have passed through the slot between the deflectors. The projections rapidly lose their energy by successive ricochets and then fall by gravity.

The slots such as 76 and 77 which are defined by the rectilinear edges such as 74*e* and 74*f* of the plates such as 74*a* and 74*d* defining each deflector such as 74, which edges are parallel to the ridges such as 74*c* where the plates meet, are preferably as small as possible while being just large enough to pass deflected projectiles.

Nonetheless, even the smallest useful slot size is still large enough to allow projectiles to pass directly towards the plate 71 if they were aimed exactly at the slot, and this is shown diagrammatically by an arrow 79.

In order to avoid such projectiles hitting the plate 71 at 90° with the risk of them returning in substantially the opposite direction to the shooting direction I, each of the slots such as 76 and 77 gives access to a corresponding secondary deflector such as 80 or 81 which is fixed to the plate 71 and which, like the deflector 73, 74 and 75 has its convex side turned towards the incoming projectiles such that any projectile hitting a secondary deflector is deflected to strike the plate 71 at an angle of less than 90°, and for example at an angle of 45°.

Thus, in the examples shown, each of the secondary deflectors such as 80 and 81 is in the form of an angle bar having two walls oriented at 45° relative to the plate 71 and meeting at a right angle along a ridge 80*a* or 81*a* which faces the associated slot such as 76 or 77, and which is at a sufficient distance from the associated slot to enable projectiles to enter the anti-ricochet assembly either by striking the slot directly in the shooting direction I or else by passing through the slot after being deflected by a deflector such as 73, 74, 75.

Naturally, other arrangements could be chosen to this end without going beyond the scope of the present invention. However, it should be observed that the present disposition is remarkably compact and extremely safe.

Numerous variants of the present invention are possible without going beyond the scope of the invention as defined by the claims.

It will readily be understood that apparatus in accordance with the present invention may be used for shooting firearms, e.g. pistols or rifles, for long-bow or cross-bow shooting, for throwing darts or knives, for sling-shooting, etc. Various adaptations may be required to make the apparatus more suitable for any given sport; however such adaptations do not go beyond the scope of the present invention.

I claim:

1. Apparatus for presenting a target at a window, the apparatus comprising a support frame rigidly supporting an opaque panel which delimits a window, together with means for presenting a target at said window and downstream therefrom relative to a predetermined approximately horizontal shooting direction, the dimensions of said target perpendicular to said shooting direction being less than the corresponding dimensions of the window, the apparatus including the improvement whereby the means for presenting the target comprise means for applying complex motion to the target, said complex motion combining rotation about an axis which is approximately horizontal and translation along a direction which is approximately perpendicular to the direction of said axis, said complex motion taking place downstream in said shooting direction from said fixed opaque panel which delimits the window, together with means for giving said rotation and said translation respective directions, and/or amplitudes and/or speeds such that the target is presented at the window in a manner which is pseudorandom in time and in trajectory between successive passes behind the panel, i.e. not at the window.

2. Apparatus according to claim 1, including means for moving at least one additional target with complex motion combining rotation about an axis which is approximately horizontal and translation along a direction which is approximately perpendicular to the direction of said axis, said motion taking place downstream relative to the shooting direction from said panel, the apparatus further including means for giving the rotation of each target and the translation of each target a respective direction, amplitude, and speed such that the targets cross at the window in a manner which is pseudorandom in time and in trajectory between successive passes behind the panel, said other target(s) as presented at the window having dimensions perpendicular to the shooting direction which are less than the corresponding dimensions of the window.

3. Apparatus according to claim 2, including means for combining with said rotation and translation movements of said targets a rotation movement about an axis which is approximately vertical, together with means for giving said rotation movement a speed and/or a direction and/or an amplitude such that the targets are presented at the window in a manner which is pseudorandom in time and in trajectory between successive passes behind the panel.

4. Apparatus according to claim 1, including means for combining with said rotation and translation movements of said target a rotation movement about an axis which is approximately vertical, together with means for giving said rotation movement a speed and/or a direction and/or an amplitude such that the targets are presented at the window in a manner which is pseudo-random in time and in trajectory between successive passes behind the panel.

5. Apparatus according to claim 1, wherein said means for presenting the target comprise:

target-carrying means;

a frame providing a connection between said target-carrying means and the support frame;

first displacement means for moving said frame relative to the support frame; and second displacement means for moving the target-carrying means relative to said frame;

and wherein one of said first and second relative displacement means comprises means for relative displacement by rotation about an approximately horizontal axis, and the other of said first and second displacement means comprises means for relative displacement in translation along a direction which is approximately perpendicular to the direction of said axis.

6. Apparatus according to claim 5, wherein said first displacement means is constituted by the means for relative displacement in rotation, said axis being fixed relative to the support frame and said frame, and wherein said second displacement means is constituted by the means for relative displacement in translation, said direction of translation being fixed relative to said frame and to the axis, and being perpendicular to the direction of the axis.

7. Apparatus according to claim 6, comprising:

means for guiding the frame in rotation relative to the support frame about an axis which is fixed relative thereto and which is approximately horizontal;

means for driving said frame in rotation relative to the support frame about said axis;

means for guiding the target-carrying means in translation relative to said in a direction which is fixed relative thereto and which is approximately perpendicular to the direction of the axis; and means for driving the target-carrying means in translation relative to said frame along said translation direction.

8. Apparatus according to claim 7 comprising:

additional target-carrying means;

means for guiding said additional target-carrying means in translation relative to said frame along an additional direction parallel to said direction of translation and fixed relative to said frame;

means for driving said additional target-carrying means in translation relative to said frame along said additional direction of translation.

9. Apparatus according to claim 8, wherein the first-mentioned means and the additional means for driving said target-carrying means in translation relative to the frame are independent from one another.

10. Apparatus according to claim 7 wherein said drive means are mutually independent.

11. Apparatus according to claim 7 including means for adjusting the speeds and/or directions and/or amplitudes of the motion of the various drive means independently from one another.

12. Apparatus according to claim 7 wherein said frame is fixed to an armor plate at least where it is visible downstream relative to said shooting direction from the window and from the target-carrying means.

13. Apparatus according to claim 12, wherein said armor plate has a plurality of juxtaposed deflectors fixed thereon, said deflectors being convex on their window-facing sides and defining projectile-receiving slots between adjacent deflectors.

14. Apparatus according to claim 13, wherein the plate has secondary deflectors additionally fixed thereto between said deflectors, with each secondary deflector being associated with a slot between an adjacent pair of said deflectors and having a convex surface facing said slot.

15. Apparatus according to claim 6 wherein said axis is approximately parallel to the shooting direction.

16. Apparatus according to claim 5, wherein one of the first and second displacement means comprises means for relative displacement by rotation about an axis which is approximately vertical.

17. Apparatus according to claim 16, wherein said first displacement means is constituted by the means for relative displacement by rotation about an axis which is approximately horizontal and by the means for relative displacement by rotation about an axis which is approximately vertical, the approximately horizontal axis being fixed relative to said frame movable in rotation about said approximately vertical axis relative to the support frame, and wherein the second displacement means is constituted by the means for relative displacement in translation, said translation direction being fixed relative to said frame and relative to the approximately horizontal axis and being perpendicular to the direction thereof.

18. Apparatus according to claim 17 comprising:

a link member linking said frame and said support frame;

means for guiding the link member in rotation relative to the support frame about an axis which is fixed relative thereto and approximately vertical;

means for driving the link member in rotation relative to the support frame about said approximately vertical axis;

means for guiding said frame in rotation relative to the link member about an axis which is fixed relative thereto and which is approximately horizontal;

means for driving said frame in rotation relative to the link member about said approximately horizontal axis;

guide means for guiding the target-carrying means in translation relative to said frame along a direction which is fixed relative thereto and which is approximately perpendicular to the direction of the approximately horizontal axis; and means for driving the target-carrying means in translation relative to said frame along said translation direction.

* * * * *